United States Patent [19]

Scott

[11] 4,116,192

[45] Sep. 26, 1978

[54] TENNIS BALL RETRIEVER

[76] Inventor: Jack C. Scott, 8547 Amestoy Ave., Northridge, Calif. 91324

[21] Appl. No.: 791,970

[22] Filed: Apr. 28, 1977

[51] Int. Cl.[2] ..... A63B 69/38

[52] U.S. Cl. ..... 124/51 R; 273/29 A; 198/642

[58] Field of Search ..... 198/450, 564, 642, 723; 273/29 A, 26 R, 176 K, 182 R, 182 A; 124/1, 4, 6, 51; 221/263, 277

[56] References Cited

U.S. PATENT DOCUMENTS

| | | | |
|---|---|---|---|
| 2,225,820 | 12/1940 | Clark | 124/6 |
| 2,765,171 | 10/1956 | Cook | 124/6 |
| 2,793,636 | 5/1957 | Cook | 124/6 |
| 3,399,660 | 9/1968 | Swartout | 124/6 |
| 3,815,907 | 6/1974 | Cook | 124/1 |
| 3,878,827 | 4/1975 | Newgarden | 124/6 |
| 3,989,246 | 11/1976 | Brown et al. | 273/29 A |
| 4,025,071 | 5/1977 | Hodges | 273/29 A |

*Primary Examiner*—Bruce H. Stoner, Jr.
*Assistant Examiner*—Jeffrey V. Nase
*Attorney, Agent, or Firm*—Blakely, Sokoloff, Taylor & Zafman

[57] ABSTRACT

A tennis ball retriever and ball transporter for retrieving tennis balls from a collection point on a court surface and transporting the balls to a ball throwing machine. The machine comprises a pinwheel having sawtooth projections enclosed by a circular wall, with a tube extending through the wall in alignment with the movement of balls around the periphery of the wall, and an electric motor for rotating the pinwheel. As balls drop into open regions between the pinwheel projections and the wall, they are engaged by the projections and driven around the periphery of the wall into the open end of the tube. The opposite end of the tube extends to the ball throwing machine, which may be disposed on top of the retriever.

16 Claims, 5 Drawing Figures

TENNIS BALL RETRIEVER

BACKGROUND OF THE INVENTION

1. Field of the Invention

The present invention relates to the field of tennis ball handling equipment, and in particular, to apparatus for retrieving and transporting tennis balls.

2. Prior Art

In the past few years, the popularity of tennis as a recreational sport has increased tremendously. The number of tennis players in the United States alone has been estimated to be in excess of 20 million, and more and more people take up the sport each year. Both neophyte and experienced players alike desire to improve and maintain their tennis skills by practice and drill exercises. One excellent and relatively convenient way for a player to get the needed practice is to utilize a ball throwing machine, thereby eliminating the requirement for a second player or even a regulation size tennis court, as the machines typically are set up in special lanes or practice alleys in which a player practices returning balls propelled by the ball machine. Since the ball throwing machines propel balls in rapid succession, a large number of balls are needed to feed the machine in order to keep the machine in operation. Even if the ball thrower is constructed with a large capacity ball hopper, a large number of balls is required to avoid very frequent interruptions of practice to pick up the spent balls and reload the ball hopper, which in turn results in having many loose balls lying on the court, distracting the player and providing possible sources of injury if the player steps on or trips over a loose ball.

To avoid these disadvantages and meet the ball requirements for these automatic machines, ball retrieval machines have been developed to retrieve balls previously thrown and to transport them to the intake of the ball throwing machine. One such type of machine uses an air pressure source to propel balls through a tube from a collection point, such as at the bottom of a slope or incline constructed in the playing surface, to the intake of the ball throwing machine. This type of ball retriever suffers the disadvantage that if one ball is not propelled with sufficient velocity to be carried through the tube to the feed of the ball thrower, and therefore lodges somewhere in the tube, the next ball will likewise stop in the tube, and a ball jam results. In a typical application of this type of machine, very high reliability is required, since it is very undesirable, particularly for commercial uses, to intermittently shut down the ball thrower to remedy a ball jam in the ball retriever mechanism.

Another type of ball transport utilizes a conveyor mechanism to lift the spent balls to the feed of the ball thrower, the conveyor having flights of buckets mounted on motor driven endless belts or chains. The balls are scooped into buckets at ground level and are lifted to the ball hopper of the throwing machine, where the bucket is inverted by the movement around a sprocket, thereby dumping the balls into the ball hopper. This type of ball transport is typically very reliable, but is very expensive to manufacture and install, and is a relatively permanent fixture.

BRIEF SUMMARY OF THE INVENTION

An apparatus for retrieving spent tennis balls from a collection point in a court surface and transporting the balls to a ball throwing machine or the like is disclosed. In the embodiment disclosed, a pinwheel member, comprising a central wheel member and sawtooth projections disposed around a circular periphery thereof, is mounted on a shaft in a box and enclosed by a circular wall member so that open regions are formed between the sawtooth projections and the wall. The pinwheel is rotated on the shaft by a motor and gear means. The end of a tube having a circumference just larger than a tennis ball is disposed through an opening in the circular member so that the end opening is aligned with the movement of balls engaged by the pinwheel in the open regions. A slot is formed in the tube adjacent the end to allow this disposition of the tube without contacting the sawtooth projections of the pinwheel. The tube extends from the ball retriever to the ball hopper of a ball throwing machine. A cover is positioned over the pinwheel and enclosure to direct tennis balls into the region of the pinwheel, where they will be engaged by a projection on the pinwheel and rotated around the periphery of the enclosure and into the tube. The tube will fill with balls and then dispose balls into the feed of the ball thrower as balls are retrieved at the collection point. Therefore the present invention is a mechanism for retrieving and transporting spent balls from a collection point at the court surface to a higher level, such as the feed of a ball throwing machine, wherein the transporting force is provided by direct engagement of the balls with a pinwheel member.

DETAILED DESCRIPTION OF THE INVENTION

Figure 1:
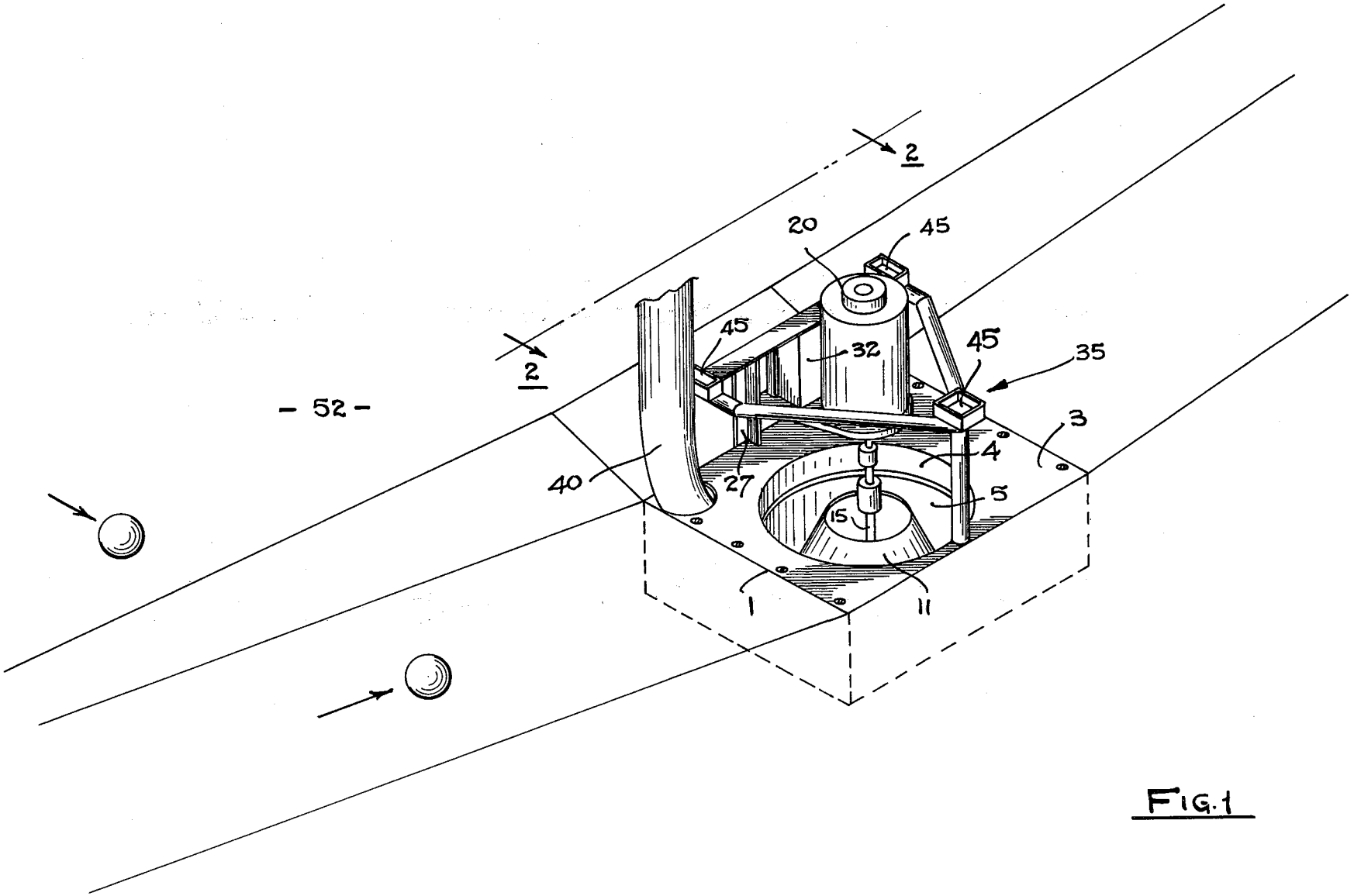
FIG. 1 is a perspective view of the preferred embodiment of the present invention for retrieving balls.

Referring now to FIG. 1, the outer box-like enclosure 1 of the ball retriever 35 is fitted in an opening in the court surface so that the edges of the cover 3 of the box 1 are flush with the adjacent edges of the court surface. The present invention typically may be utilized in conjunction with a playing surface at least a portion of which is gently sloped away from the player's position, in order that the spent balls will roll away from the player. Also the sides of the court surface adjacent the machine 35 slope gently toward cover 3 of ball machine 35, so that the balls will automatically feed into the ball retriever. Normally a fence or net is disposed just behind the machine 35 to confine balls hit by the player to the region of the retriever. Thus, because of the relative lower elevation of cover 3 with respect to the adjacent court surface, a collection area for loose balls is formed in the vicinity of the cover 3, and the balls will roll toward and into the opening in cover 3. The ball retriever and transporter operates to retrieve the balls from the cover 3 and transport them to the ball hopper of a ball throwing machine, such as is shown in my copending application, Ser. No. 676,410, entitled "Tennis Ball Throwing Machine," filed Apr. 13, 1976, which may be disposed on the supports 45 on the retriever.

The preferred embodiment of the present invention comprises (i) a rectangular box member 1 forming an outer enclosure, (ii) a circular wall 5 disposed in the interior of the box 1, (iii) a pinwheel member 10 mounted on the rotating shaft 15 inside circular wall 5 and having sawtooth projections extending from the periphery thereof, (iv) a tube 40 disposed into box 1 and entering an opening in circular wall 5, the end of the tube 40 disposed adjacent the outer periphery of the pinwheel 10, (v) a concave cover member 3, covering the open top of the rectangular box member 1 and having an opening 4 to allow balls to drop into the pinwheel region, and through (vi) a drive system for rotating the pinwheel.

The box member 1 of the preferred embodiment is rectangular and provides an enclosure for the circular wall 5, pinwheel 10 and the tube 40 which is located adjacent the circular wall. The box could be shaped in other configurations, so long as the pinwheel 10, the circular wall 5, and the tube 40 are accommodated, and the motor drive means which rotates the pinwheel is supported. Disposed within box 1 is a sheet metal wall 5 forming a circular perimeter, in the preferred embodiment having an inner diameter of 12 inches. The height of the wall should be sufficient to retain the tennis balls within the interior. The wall 5 is secured by conventional fastening means to the bottom panel of the box 1 to prevent movement during the operation of the retriever.

Figure 4:
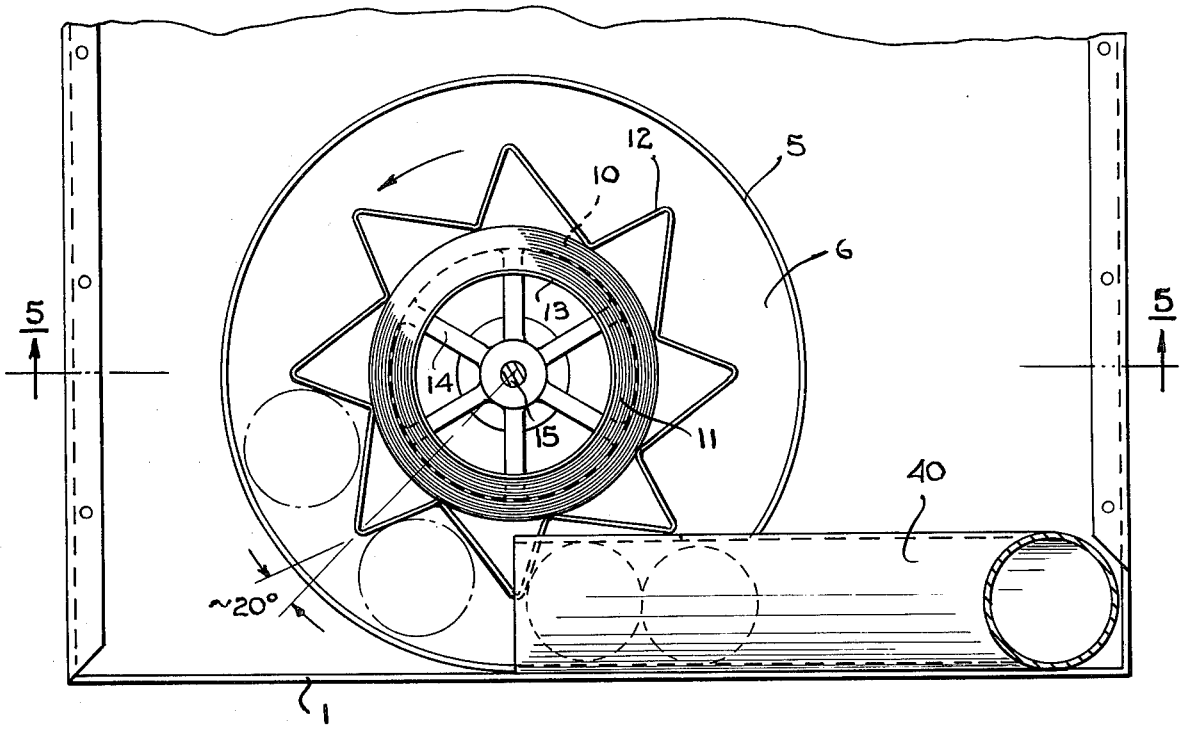
FIG. 4 is a cross-sectional top view of the ball retrieval machine, taken along line 4—4 of FIG. 2, showing the pinwheel and circular enclosure member.
Figure 5:
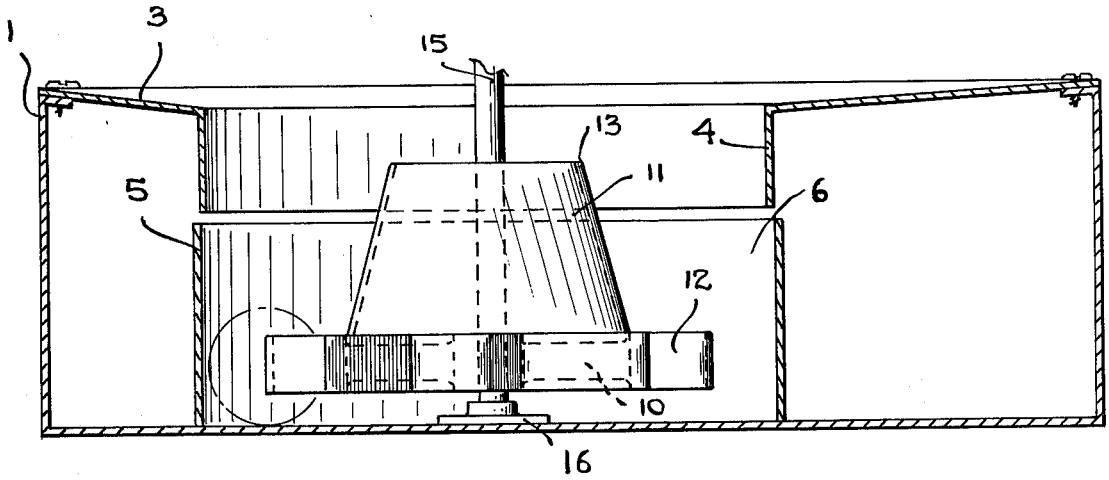
FIG. 5 is a cross-sectional rear view of the ball retrieval machine taken along line 5—5 of FIG. 4.

Referring now to FIGS. 4 and 5, centrally located within the enclosure 6 defined by the circular wall 5 is a pinwheel member 10. Pinwheel member 10 is transfixed by and secured to shaft 15, which extends perpendicularly through the central axis of the pinwheel 10 to the bottom of the box 1. The shaft 15 in turn rotates in the counterclockwise direction on bearing 16 which is fastened to the bottom panel of the box 1. The pinwheel member 10 comprises a wheel member 13, the hub 14 of which is transfixed by the shaft 15, and a plurality of sawtooth projections 12 extending outward from the periphery of the of the wheel. Of course, the pinwheel member could be fabricated by alternative methods, as for example, a pinwheel wherein the hub and projections are integrally formed. As is seen in FIG. 4, a plurality of projections 12 are attached to the periphery of wheel 13. As a ball drops into an open region between the projections 12 and the wall 5, it is urged around the periphery of the wall 5 into tube 40 by engagement with a projection 12, as will be described below more fully. For reliable operation of the ball retriever, the shape of the projections 12 must be carefully chosen so as to avoid ball jams. The projections should be fabricated so that the angle defined by the intersection of the leading edge with a radial line from the hub center through the tip of the projection is approximately in the range of 0° to 30°, and preferably approximately 20°. Also important is the distance which the projection extends out from the the wheel 13 in relation to circular wall 5. The tips of the projections 12 should extend a sufficient distance to prevent the ball from becoming wedged between the tip and wall 5, and should be rounded on the tips to avoid "biting into" the balls. Therefore the projections must extend out at least far enough to engage and advance balls in the open regions, preferably extending to the circle defined by the center of the balls between projections, e.g., approximately one ball diameter less than the inner diameter of wall member 5.

Referring now to FIG. 5, the pinwheel member 10 has a height substantially less than the ball diameter and is elevated above the bottom panel of box 1 so that the sawtooth projections strike the tennis balls at approximately their mid-points.

Conical collar 11 is coupled to the upper surface of wheel member 13 and extends upward to a level just beneath the cover 3, and sufficiently close to shaft 15 to prevent balls from lodging therebetween. Balls passing through opening 4 in the cover 3 are guided by the collar 11 and circular wall 5 so as to sequentially fall into the open regions between the projections of the pinwheel member.

Figure 2:
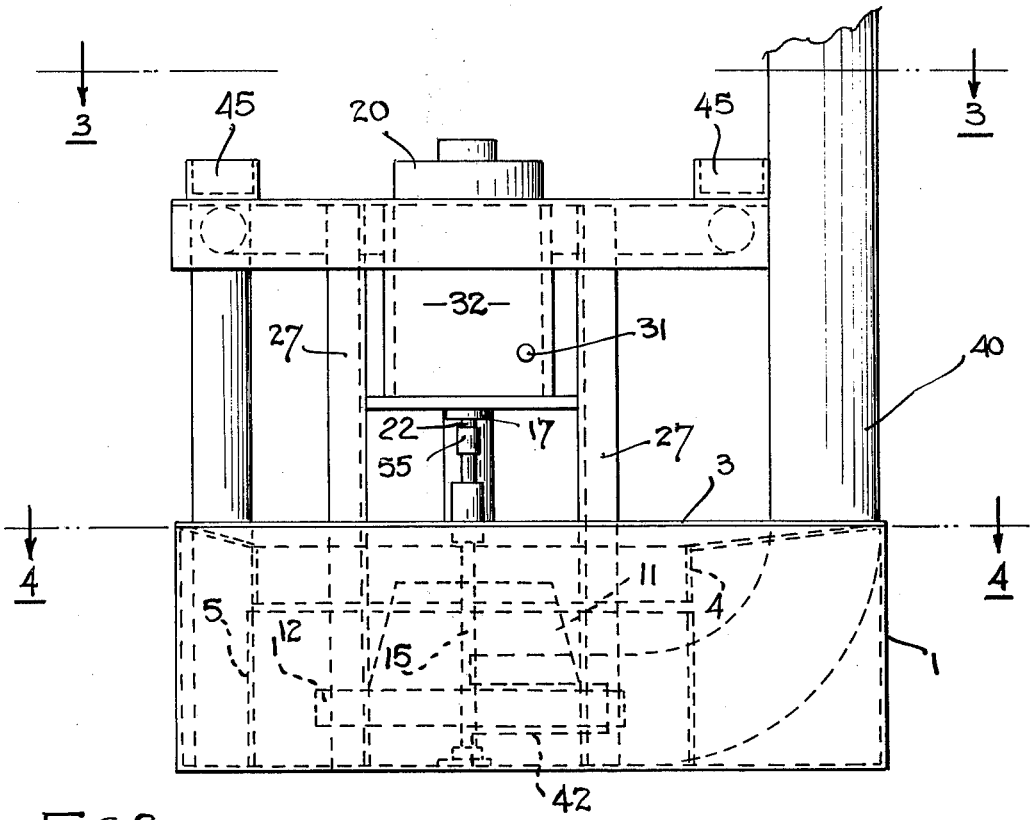
FIG. 2 is a cross-sectional rear view of the ball retrieval machine, taken along line 2—2 of FIG. 1.
Figure 3:
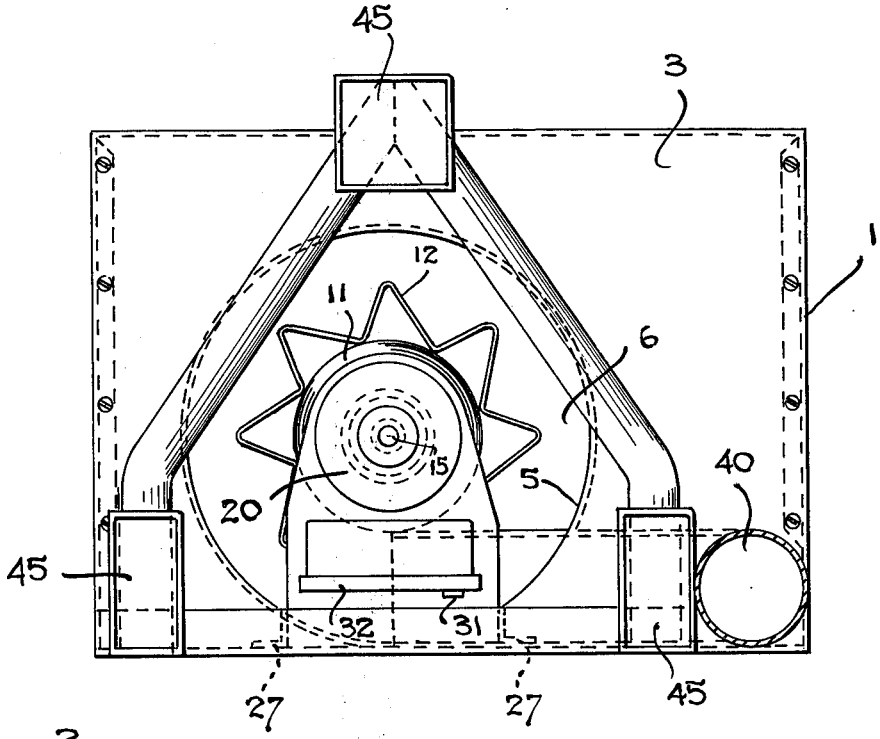
FIG. 3 is a cross-sectional view of the ball retrieval machine, taken through line 3—3 of FIG. 2, and showing the means for driving the rotating pinwheel member.

Referring now to FIGS. 2 and 4, cover member 3 attaches by screws or other conventional fastening means to the sides of box 1 and preferably extends to a position adjacent wall 5. Cover member 3 is formed with a downard facing concavity, so that as balls are disposed or roll onto the cover member 3, they will tend to roll towards the opening 4 automatically gravitating to an open space on the pinwheel. In this regard, in normal use, the retriever is capable of retrieving balls faster than they are served, so that the pinwheel should not become "flooded" with balls.

Referring now to FIGS. 1 and 2, the means for rotating the pinwheel member 10 and shaft 15 comprises a gear member supported above box 1 by angle support members 27 attached to the rear side of box 1. Gear motor 20 is secured with its output shaft 22 aligned with shaft 15, and is attached thereto through a short flexible coupling 55. Gear motor 20 is energized through electrical panel 32, which panel includes circuit breaker 31 for protection against electrical current overloads. In the preferred embodiment the gear motor used has an overload reversing characteristic, whereby on stalling in the case of a jam, the motor momentarily reverses, thereby providing the retriever with a tendency to automatically clear jams.

Tube 40, having a diameter somewhat larger than the ball diameter, is disposed through an opening in circular wall 5 with the bottom of the tube adjacent the bottom of box 1 so that the tube opening is aligned with the movement of balls around the wall 5. A slot 42 (FIG. 2) is provided on the inner portion of the end of tube 40, the slot 42 being sufficient in size to allow room for the rotating projections of the pinwheel member 10 to pass therethrough, so that the side of the tube adjacent the wheel projections will contact and guide the balls into the tube. A 90° bend is formed in the tube, as shown in FIG. 4 so as to bring the tube 40 out through the top of box 1. The length of tube 40 may then be formed (or extended) in the desired shape to bring the opposite end of the tube to the feed of the ball throwing machine. For this purpose it has been found convenient to bring the balls up vertically, allowing them to spill over into a sloped trough for horizontal transport. This avoids any jamming tendency caused by a second bend in the delivery tube.

Having described the structure of the present invention, the operation of the ball retriever will now be explained. Due to the nature of the practice court, either by design or by the addition of a suitable trough at the end of a conventional court, spent balls will roll onto the cover member 3, dropping down into the interior of the box member 1. The dropping ball will be confined by the conical collar 11 and the cylindrical wall 5, proceeding into an open region between the sawtooth projections 12 and the cylindrical wall 5. The tennis ball will be constrained to roll around the periphery of the wall 5 due to the engagement by the leading edges 14 of these projections and, as the tube end is reached, will then be guided into the end of the tube 40. As more balls are loaded into the ball retrieving machine, the tube will fill up with balls and, once the tube is filled, the overflow from the tube will feed the ball throwing machine. Of course the tube may be filled with balls prior to the beginning of operation or from prior use, so that each ball retrieved results in a ball being fed into the ball throwing machine. For maximum reliability, the inner diameter of tube 40 should just exceed the diameter of the largest (new) tennis balls, and the pinwheel parameters should be as stated herein.

The present invention provides reliable operation, as the balls are driven by direct contact with the projections on the driving wheel. Therefore, the jamming problems incident to an air blower type of ball retriever are avoided. Moreover, the device may be fabricated from inexpensive sheet metal, and does not require the complex assemblies required for the conveyor types of ball retrieving devices.

There has been described herein the preferred embodiment of the present invention. It is to be noted, however, that alternative embodiments may be readily fabricated by one skilled in the art. Thus while the preferred embodiment of the present invention has been disclosed herein, various changes in form and detail may be made therein without departing from the spirit and scope of the invention.

I claim:

1. A ball retriever and transporter comprising:

a pinwheel member having a central axis and a plurality of projections disposed around a circular periphery thereof, each of said projections having a vertical extent substantially less than a ball diameter;

a wall member encircling at least a portion of said pinwheel member, said plurality of projections on said pinwheel member in combination with said circular member defining a plurality of ball receiving open regions;

means for rotating said pinwheel about said central axis;

means for disposing loose balls into said open regions between said wall member and said projections;

a hollow tube member having a first end disposed through said wall member adjacent said pinwheel and said wall member so that said first end is aligned with the movement of balls around said wall and having a second end thereof disposed adjacent a final destination point, said tube member having an open region at a side thereof adjacent said pinwheel member so as to allow passage of said projections thereby;

whereby said balls disposed in said open regions in said wall are engaged by said pinwheel and constrained to roll around at least a portion of the interior of said wall in contact with said wall member and said pinwheel, and then into the hollow tube member for forcible transport through said tube member.

2. A ball retriever and transporter of claim 1 further comprising a box member for enclosing said wall member and providing support for said means for rotating said pinwheel.

3. The ball retriever and transporter of claim 1 wherein said means for disposing balls into said open regions in said enclosure includes a concave cover member disposed above said wall member and having an opening formed therein for allowing balls to successively pass from the upper surface of said cover into said ball receiving open regions.

4. The ball retriever and transporter of claim 3 wherein said means for rotating said pinwheel about said central axis includes a substantially vertical shaft transfixing the center of said pinwheel member and coupled to a gear motor thereabove.

5. The ball retriever and transporter of claim 4 further comprised of a conical collar disposed around said shaft in engagement with the upper surface of said pinwheel member and below said cover member, whereby balls passing into said retriever are successively directed into said open regions by said collar and said wall members.

6. The ball retriever and transporter of claim 1 wherein said projections are sawtooth in shape.

7. The ball retriever and transporter of claim 6 wherein the leading edges of said sawtooth projections define an angle of between 0° and 30° with respect to a radial line drawn from the pinwheel center through the tip of each said projection.

8. The ball retriever and transporter of claim 6 wherein the leading edges of said sawtooth projections define an angle of approximately 20° with respect to a radial line drawn from the pinwheel center through the tip of said projection.

9. The ball retriever and transporter of claim 1 wherein the diameter of the circle defined by the tips of said projections is approximately one ball diameter less than the diameter of the encircling wall member.

10. A ball retriever and transporter comprising:

a frame assembly defining a base surface;

a pinwheel member disposed above said base surface of said frame assembly and having a central substantially vertical axis and a plurality of projections disposed around a circular periphery thereof, each of said projections having a rounded tip portion and having a vertical extent substantially less than a ball diameter;

a wall member coupled to said frame assembly and encircling at least a portion of said pinwheel member, said plurality of projections on said pinwheel member in combination with said circular member defining a plurality of ball receiving open regions, said wall member and said pinwheel member being cooperatively proportioned so that the tip of each projection extends approximately to the midpoint trajectory of a ball in the respective ball receiving region;

means coupled to said frame assembly for rotating said pinwheel about said central axis;

means for disposing loose balls into said open regions between said wall member and said projections;

a tubular member having a first end disposed through said wall member adjacent said pinwheel and said wall member so that said first end is aligned with the movement of balls around said wall and having a second end thereof disposed adjacent a final destination point, said tubular member having an open region at a side thereof adjacent said pinwheel so as to allow passage of said projections thereby;

whereby said balls disposed in said open regions in said wall are engaged by said pinwheel and constrained to roll around at least a portion of the interior of said wall in confined by said wall member and said pinwheel, and then into the hollow tubular member for transport through said tube member.

11. The ball retriever and transporter of claim 10 wherein said means for disposing balls into said open regions in said enclosure includes a concave cover member disposed above said wall member and substantially enclosing said box member, and having an opening formed therein for allowing balls to successively pass from the upper surface of said cover into said ball receiving open regions.

12. The ball retriever and transporter of claim 11 wherein said means for rotating said pinwheel about said central axis includes a gear motor coupled to said frame assembly above said pinwheel.

13. The ball retriever and transporter of claim 12 further comprised of a conical collar disposed around said shaft in engagement with the upper surface of said pinwheel member and below said cover member, whereby balls passing into said retriever are successively directed into said open regions by said collar and said wall members.

14. The ball retriever and transporter of claim 10 wherein said projections are sawtooth in shape.

15. The ball retriever and transporter of claim 14 wherein the leading edges of said sawtooth projections define an angle of between 0° and 30° with respect to a radial line drawn from the pinwheel center through the tip of each said projection.

16. The ball retriever and transporter of claim 14 wherein the leading edges of said sawtooth projections define an angle of approximately 20° with respect to a radial line drawn from the pinwheel center through the tip of said projection.

* * * * *